United States Patent [19]

Szostak et al.

[11] Patent Number: 4,530,298

[45] Date of Patent: Jul. 23, 1985

[54] ARRANGEMENT FOR SUPPRESSING NOISE AND PREVENTING FAULTY STITCH FORMATION IN A SEWING MACHINE

[75] Inventors: Jan Szostak, Lincroft; Henry Schaeflern, Pittstown, both of N.J.

[73] Assignee: The Singer Company, Stamford, Conn.

[21] Appl. No.: 634,511

[22] Filed: Jul. 26, 1984

[51] Int. Cl.[3] ..... D05B 27/22

[52] U.S. Cl. ..... 112/315; 112/463

[58] Field of Search ..... 112/315, 158 A, 158 R, 112/158 B, 158 C, 314, 316, 317

[56] References Cited

U.S. PATENT DOCUMENTS 3,043,253 7/1962 Wank et al. ..... 112/315

3,067,702 12/1962 Shimada ..... 112/158 A 3,753,411 8/1973 Graham et al. ..... 112/315

4,448,141 5/1984 Szostak et al. ..... 112/315

*Primary Examiner*—H. Hampton Hunter

*Attorney, Agent, or Firm*—William V. Ebs; Robert E. Smith; Edward L. Bell

[57] ABSTRACT

A sewing machine which is operable in either a cam controlled feeding mode or a manually controlled feeding mode is provided with a spring which is moved into loading engagement with a feed regulating control lever by mode selecting mechanism when the selecting mechanism is disposed for manual control, and is moved away from the feed regulating control lever when the selecting mechanism is disposed for cam controlled feeding.

5 Claims, 6 Drawing Figures

ARRANGEMENT FOR SUPPRESSING NOISE AND PREVENTING FAULTY STITCH FORMATION IN A SEWING MACHINE

BACKGROUND OF THE INVENTION

1. Field of the Invention

The invention is directed to an arrangement for suppressing noise and preventing faulty stitch formation in a sewing machine.

2. Description of the Prior Art

In sewing machines which are operable in either a cam controlled feeding mode or a manually controlled feeding mode, as described, for example, in U.S. Pat. No. 4,448,141 for "Sewing Machine Cam Controlled Feed Engaging and Disengaging Mechanism" of J. Szostak et al, issued May 15, 1984, it is essential that the feed regulating mechanism be lightly loaded during cam controlled feeding to prevent undue wear of the feed pattern cam, and that the feed regulating mechanism be additionally loaded during manually controlled feeding to prevent excessive and faulty stitch formation.

It is prime object of the present invention to provide a sewing machine, which is operable in either a manually controlled feeding mode or a cam controlled feeding mode, with an improved arrangement assuring an increased load on feed regulating mechanism during manually controlled feeding, and a decreased load during cam controlled feeding.

It is another object of the invention in a sewing machine, which is operable in either a manually controlled feeding mode or cam controlled feeding mode, to provide for the movement of a spring into loaded engagement with a feed regulating control member when mode selecting mechanism is disposed for manual control, and out of loaded engagement when the mode selecting mechanism is disposed for cam controlled feeding.

Other objects and advantages of the invention will become apparent during a reading of the specification taken in connection with the accompanying drawings.

SUMMARY OF THE INVENTION

A sewing machine in accordance with the invention includes a feed regulating cam, a follower for the cam, a manual control with a plunger, and mechanism responsive to the manual control for operably connecting a feed regulating control lever to the cam follower for movement thereby, and for disconnecting the control lever therefrom for movement by the plunger. A spring urges the cam follower with a light biasing action against the cam while the control lever is operably connected to the cam follower, and biases the lever toward a position of engagement with the plunger. An additional spring is affixed to said connecting mechanism for movement thereby into a position to engage and load the control lever along with the first mentioned spring against the plunger as the mechanism is moved by the manual control to disconnect the control lever from the cam follower, and for movement by the mechanism away from the control lever as said mechanism is moved by the manual control to operably connect the control lever and cam follower.

DESCRIPTION OF THE PREFERRED EMBODIMENT

Figure 1:
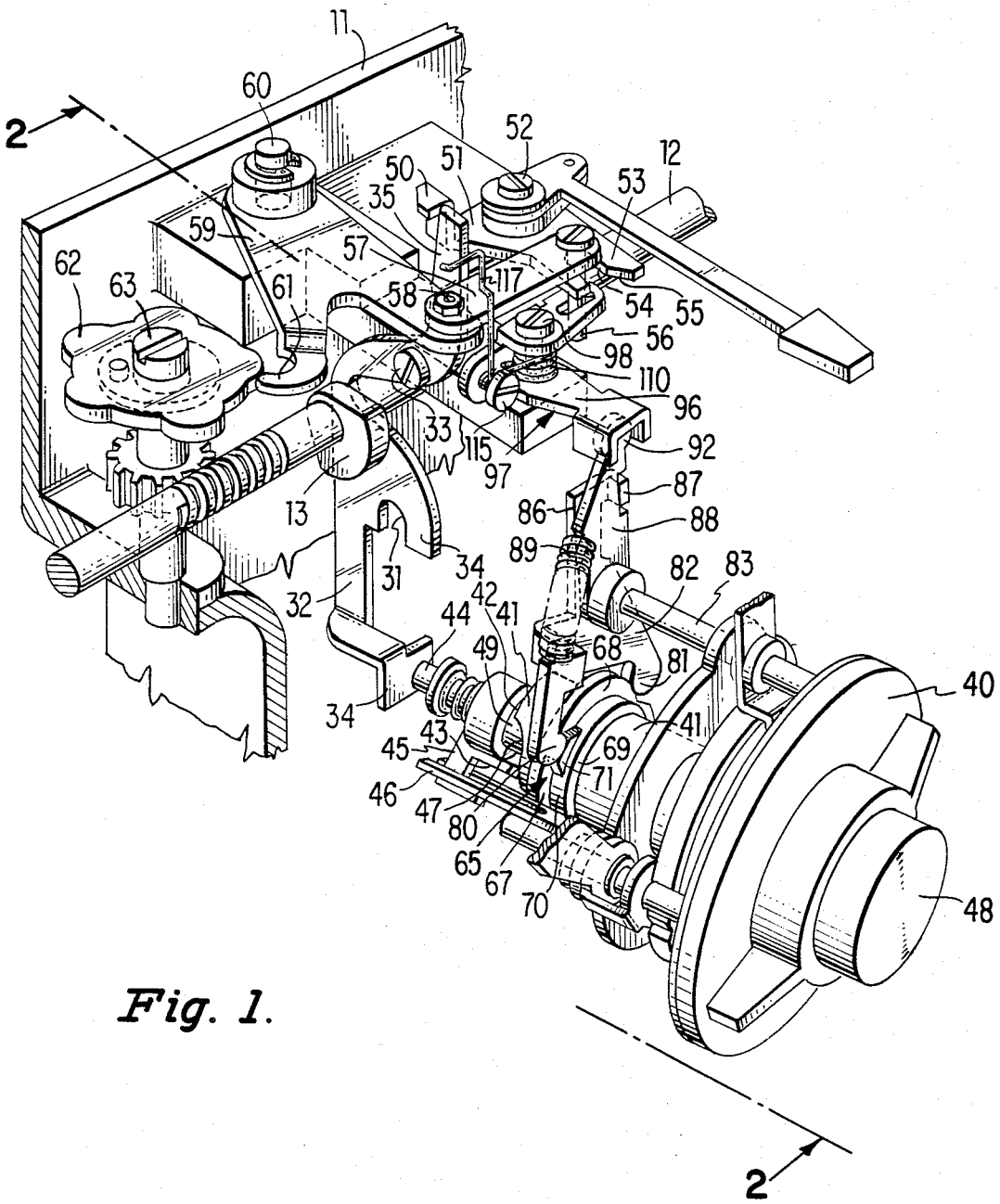
FIG. 1 is a front perspective view of a portion of a sewing machine bracket arm which has been cut away to shown the arrangement of the invention.

This invention is applicable to a sewing machine having any conventional work feeding mechanism which is capable of regulation to vary the magnitude and direction in which the work fabrics are fed, and particularly those in which manual regulation of the work feed is accomplished by means of a rotary element such as a dial or the like. U.S. Pat. No. 3,753,411, Aug. 21, 1973 of Graham et al, which illustrates one such sewing machine is incorporated herein by reference.

As shown in the accompanying drawings, reference character 11 indicates the frame of a sewing machine in which a main drive shaft 12 is journaled. Fast on the main drive shaft 12 is a constant breadth cam 13 which is embraced by the bifurcated head 14 of a feed advance drive pitman 15. Pivotally secured on a pin 16 to the pitman 15 is a slide block 17 constrained in a guide slot 18 of a feed regulating block 19 which is pivotally supported on a pivot pin 20 which is affixed in the machine frame. The angular position of the feed regulating block determines the magnitude and direction of fabric feed. Since any conventional work feeding mechanism such as a four-motion drop feed mechanism may be used with this invention, a complete sewing machine work feeding mechanism is not shown in the accompanying drawings.

A pin 30 secured to the feed regulating block 19 in spaced relation to the pivot pin 20 is embraced by a slot 31 formed in a lever 32 which is fulcurmmed on a pin 33 fixed in the machine frame 11. The lever 32, which thus influences the angular position of the feed regulator block 19, is formed with a downturned arm 34 and an upturned arm 35. A lightly loaded torsion spring 36, having opposite ends 38 and 39 affixed in pin 20 and engaged with lever 32 respectively, biases the lever toward engagement on downturned arm 34 with a manually influenced control part, as will be described below, and toward engagement on upturned arm 35 with a pattern cam influenced control which will also be described below.

Figure 2:
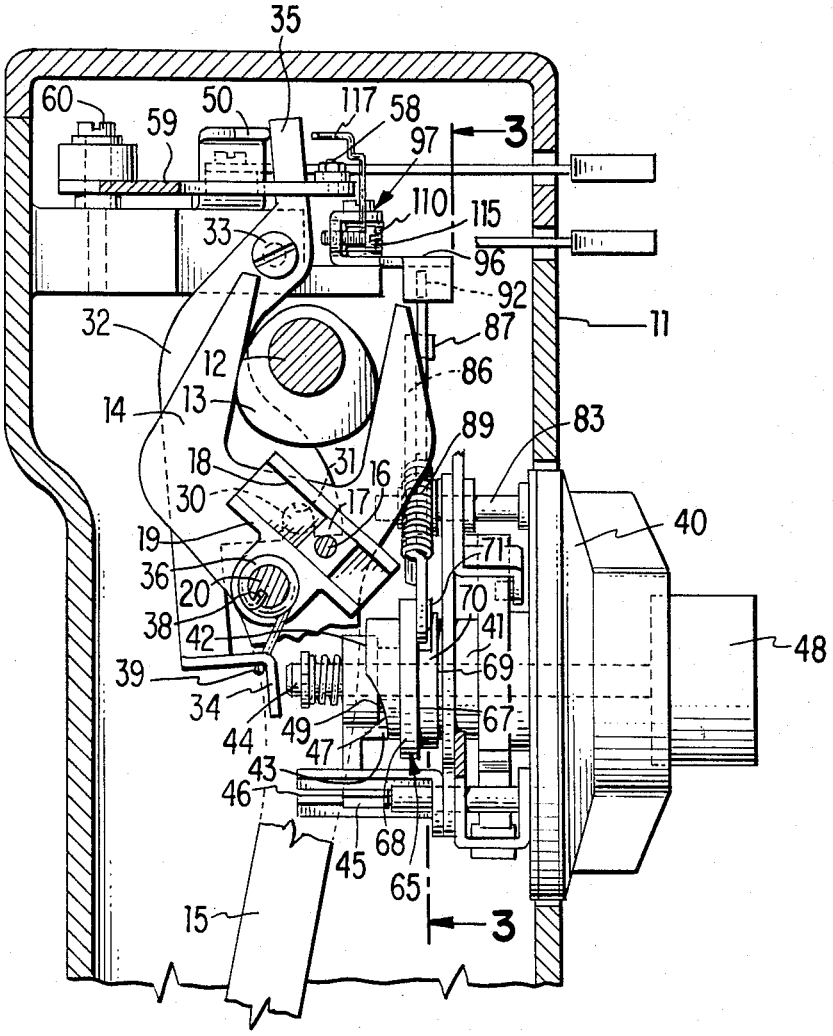
FIG. 2 is a side elevational view taken substantially on the plane of the line 2—2 of FIG. 1 and showing the sewing machine bracket arm in vertical cross section.

The manually influenced control, as best illustrated in FIGS. 1 and 2 of the drawings, includes an operator influenced dial 40 journaled in the frame 11 of the sewing machine and formed integrally with a cylindrical boss 41 having a face cam surface 42 engaged by a follower 43 which is carried on a spring biased sleeve 49. An arm 45 on the follower slidably engages a guide 46 carried in the machine frame. The face cam surface 42 includes a dwell segment 47 which extends for approximately 30 degrees of the cylindrical boss 41 and which when tracked by the follower 43, dictates that the work feed regulation be maintained in maximum stitch length in the forward direction. The manually influenced control also includes an axially shiftable pushbutton 48 for rapidly moving a plunger 44 to the left as viewed in FIG. 2 to provide a quick feed reverse. The plunger 44 is engageable with the downturned arm 34 of the lever 32.

Referring to FIG. 1, the upturned arm 35 of the lever 32 extends in the path of movement of an arm 50 of a bell crank 51 fulcurmmed on a pin 52 carried in the machine frame 11. The other arm 53 of the bell crank lever 51 is formed with a radial slot 54 having a flaired mouth 55.

A pin 56 depending from connecting link 57 is adapted selectively to be shifted into and out of bell crank lever slot 54 as will be described hereinbelow. The connecting link 57 is pivoted by a shouldered screw 58 to a pattern cam follower lever 59 sustained on a pivot pin 60 in the machine frame and formed with a cam follower finger 61 adapted to track the periphery of a plastic feed controlling pattern cam 62 fast on a cam shaft 63 driven from the main drive shaft 12.

For selectively connecting or disconnecting the feed pattern cam follower lever 59 and the link 57 with the lever 32 which influences the stitch length and direction of work feed, a sleeve 65 is secured to the cylindrical boss 41 of the manual stitch length regulating dial 40. The sleeve includes a flange 67 with an outer cylindrical surface 68, and a base portion 69 with an outer cylindrical surface 70. A radial cam lobe 71 occupies a small angular segment, which need not exceed 30 degrees, of sleeve 65.

Fingers 80 and 81, formed on a follower lever 82 which is fulcurmmed on a pin 83 carried in the machine frame, track a sloped surfacce 84 on cam lobe 71 and a sloped surface 85 on flange 67, respectively, to positively connect lever 32 with cam follower lever 59 and link 57 for operation thereby while the dwell segment 47 of the face cam 42 is effective. At other times, fingers 80 and 81 track surfaces 70 and 68, respectively of sleeve 66 to prevent operation of lever 32 by cam follower lever 59 and link 57. An upturned arm 86 on follower lever 82 includes an offset finger 87 engageable with a rock arm 88 which is journaled on pin 83. A compression spring 89 constrained between a seat 90 formed on the follower lever 82, and a seat 91 formed on the rock arm 88 biases the rock arm toward the offset finger 87. The rock arm terminates in a circular head 92 which is embraced between flanges 93 depending from one arm 96 of a bell crank 97 pivoted on a pin 98 in the machine frame. A second arm 99 of the bell crank 97 is formed with a radial slot 100 which embraces the pin 56.

As the operator influenced control member 40 is shifted into the range in which the dwell segment 47 of cam 42 is effective, finger 81 slides down sloped surface 85 on flange 67, and the sloped surface 84 of cam lobe 71 acts positively on finger 80 to engage the feed pattern cam control with the work feed regulator by swinging the pin 56 on link 57 into slot 54 of bell crank lever 51. As the operator influenced control member 40 is shifted out the range in which the dwell segment 47 of cam 42 is effective, finger 80 slides back down the cam lobe surface 84 and the sloped surface 85 of flange 67 acts positively on finger 81 to disengage the feed pattern cam control from the work feed regulator by swinging pin 56 on link 57 out of a slot 54 of the bell crank.

A coil spring 110 is adjustably secured to bell crank 97 for movement therewith. The spring coils encircle pin 98, and a lower end tang 111 engages wall 113 of the bell crank 97. The spring includes an extended portion 114 which is engaged by the head 115 of a screw 116 that is threaded into wall 113. The screw may be adjusted to contract or permit expansion of the spring coils while tang 111 is in engagement with wall 113, and in this way extended portion 114 of the spring may be adjusted to predetermine the extent to which the spring shall be capable of loading lever 32.

Figure 4:
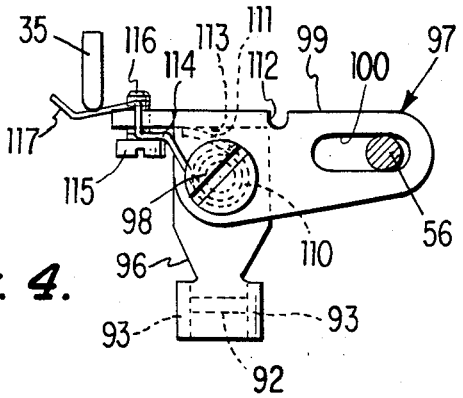
FIG. 4 is a fragmentary top view taken substantially on the plane of the line 4—4 of FIG. 3.
Figure 3:
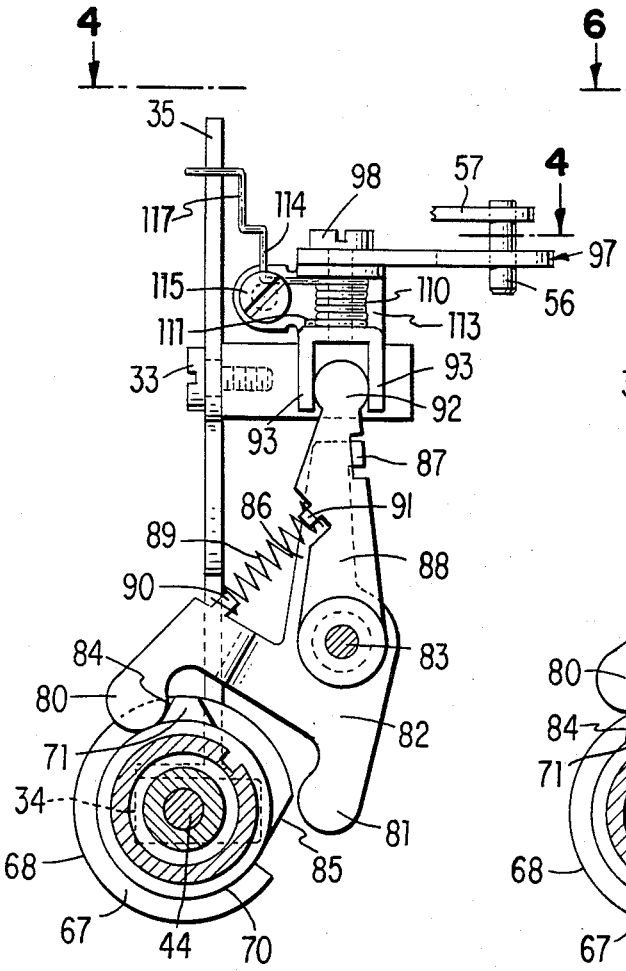
FIG. 3 is a cross-sectional view taken substantially on the plane of the line 3—3 of FIG. 2, and showing mode selecting parts disposed in a manually controlled feeding position.

Spring 110 is positioned by bell crank 97 to cause the upper end 117 of spring portion 114 to engage and load lever 32 at arm 35 with a biasing force, according to the adjustment of screw 116, when the feed pattern control is disconnected from lever 32 and manual control is in effect (FIGS. 3 and 4). Spring 110 then supplements the effect of light loading torsion spring 36 to maintain lever 32 in engagement with plunger 44 at downturned arm 34. The spring thereby prevents chatter due to vibrational forces which tend to cause the lever 32 to bounce against the plunger when pushbutton 48 is fully depressed to effect a quick feed reversal during operation of the machine. The spring also prevents the shortening of stitches during manual control in all dial controlled positions of the plunger 44 while multiple layers of heavy material are sewn and vibrational forces are thereby created tending to move lever 32 out of contact with plunger 44.

Figure 6:
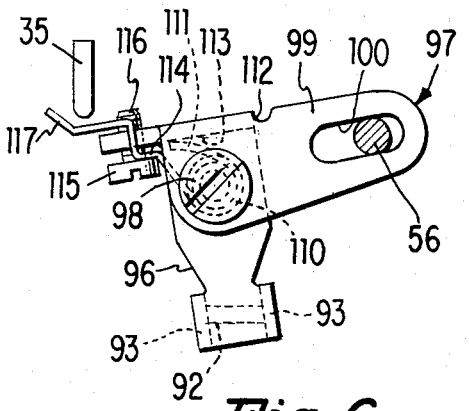
FIG. 6 is a fragmentary top view taken substantially on the plane of the line 6—6 of FIG. 5.
Figure 5:
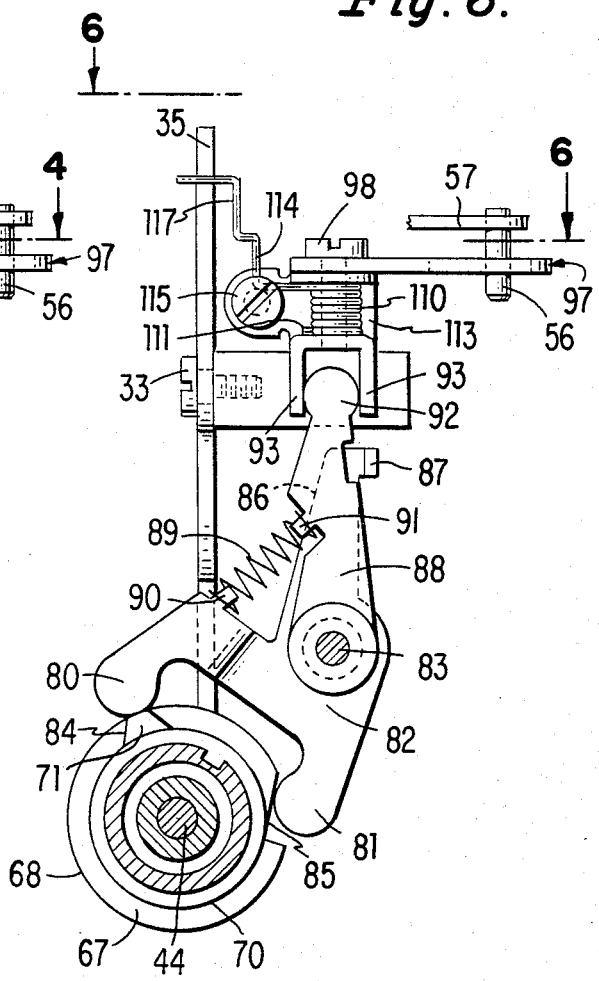
FIG. 5 is a view similar to FIG. 3 showing the mode selecting parts disposed for cam controlled feeding.

When dial 40 is disposed to engage the feed pattern control with the work feed regulator, spring 110 is positioned by bell crank 97 to separate spring end 117 from lever 32 (FIGS. 5 and 6). During feed pattern controlled operations, plunger 44 is in the maximum stitch length position, that is furthest to the right as viewed in FIG. 2, and lever 32 is held apart from the plunger by cam 62 acting through connecting linkages. The lever is then held in engagement with the feed pattern control at arm 50 by the force of the light loading torsion spring 36 which is sufficient to maintain cam follower finger 61 in engagement with plastic cam 62 without causing undue wear of the follower engaging surface of the cam.

It is to be understood that the present invention relates to a preferred embodiment of the invention which is for purposes of illustration only, and is not be be construed as a limitation of the invention, Numberous alterations and modifications will suggest themselves to those skilled in the art, and all such modification which do not depart from the spirit and scope of the invention are intended to be included within the scope of the appended claims.

We claim:

1. In a sewing machine; a feed regulating cam; a follower for the cam; a manual control including a plunger; a feed regulating control lever; mechanism responsive to the manual control for operably connecting the control lever to the cam follower for movement thereby and for disconnecting the control lever therefrom for movement by the plunger; a spring which urges the cam follower against the cam while the control lever is operably connected to the cam follower, and biases the lever toward a position of engagement with the plunger; and an additional spring affixed to said mechanism for movement thereby into a position to engage and load the control lever along with the first mentioned spring against the plunger as said mechanism is moved by the manual control to disconnect the control lever from the cam follower, and for movement by said mechanism away from the control lever as the mechanism is moved by the manual control to operably connect the control lever and cam follower.

2. The combination of claim 1 including means for adjusting said additional spring to selectively predetermine the load to be exerted thereby on the feed regulating control lever.

3. The combination of claim 1 wherein said mechanism includes a bell crank and the additional spring is a coil spring which is secured thereto and has an extended end engageable with the feed regulating control lever.

4. The combination of claim 4 wherein the coils of the additional spring extend about a pivot pin for said bell crank.

5. The combination of claim 4 wherein the end of the spring opposite from the extended end engages the bell crank and the extended end is adjustably movable by a screw threaded into the bell crank.

* * * * *